US005374093A

United States Patent [19]

Klopfenstein

[11] Patent Number: 5,374,093

[45] Date of Patent: Dec. 20, 1994

[54] GRIPPER ASSEMBLY

[75] Inventor: Andrew L. Klopfenstein, Tipp City, Ohio

[73] Assignee: AM International Inc., Chicago, Ill.

[21] Appl. No.: 805,120

[22] Filed: Dec. 10, 1991

[51] Int. Cl.[5] ..... B65H 29/06; B65G 47/86

[52] U.S. Cl. ..... 294/104; 271/204; 271/277

[58] Field of Search ..... 294/104, 99.1; 198/803.7, 803.9; 271/204, 206, 277

[56] References Cited

U.S. PATENT DOCUMENTS

| | | | |
|---|---|---|---|
| 4,381,056 | 4/1983 | Eberle | 294/104 X |
| 4,681,213 | 7/1987 | Winiasz | 198/803.9 |
| 4,905,818 | 3/1990 | Houseman | 198/803.7 |
| 4,921,294 | 5/1990 | Klopfenstein | 294/104 X |
| 4,968,081 | 11/1990 | Beight et al. | 294/104 |
| 5,064,187 | 11/1991 | Müller | 198/803.7 X |

*Primary Examiner*—Dean J. Kramer
*Attorney, Agent, or Firm*—Tarolli, Sundheim & Covell

[57] ABSTRACT

A gripper assembly for clamping articles comprises a first clamp member and a second clamp member pivotal relative to the first clamp member. An actuator pivots the second clamp member relative to the first clamp member from an open position into a closed position. A coil spring is compressed when the second clamp member is in the open position. A pin engaging in a slot maintains the coil spring in the compressed condition when the second clamp member is in the open position. A releasable locking device holds the second clamp member in a closed position. The locking device includes a latch that can be mounted in one of two positions on the first clamp member. The latch is biased into engagement with one of two latch blocks, depending on the position of the latch, to hold the second clamp member in the closed position.

14 Claims, 2 Drawing Sheets

GRIPPER ASSEMBLY

BACKGROUND OF THE INVENTION

The present invention relates to a gripper assembly for clamping a sheet material article, such as a newspaper or newspaper insert, that is to be transported by the gripper assembly.

A known gripper assembly for gripping a sheet material article, such as a newspaper, is disclosed in U.S. Pat. No. 4,381,056. The gripper assembly disclosed in this patent has a movable clamp member which is held in clamping engagement with an article by a pawl arrangement. The pawl arrangement includes a wheel which is connected to the movable clamp member. After the wheel has been rotated to a predetermined position, a pawl engages a gap in the wheel to hold the gripper in clamping engagement with the article. The movable clamp member is biased to an open position by a spring.

SUMMARY OF THE INVENTION

The present invention relates to a gripper assembly having a first clamp member and a second clamp member pivotal relative to the first clamp member. An actuation means pivots the second clamp member relative to the first clamp member. A releasable locking device for holding the second clamp member in a closed position includes a latch engagable with one of a pair of latch blocks. The latch is released from the latch block by engaging the latch with a cam means. A spring means which is connected between the latch blocks and the second clamp member is preloaded to permit gripping of thin articles.

When the latch is mounted in a first position on the first clamp member, the latch is engagable with a first latch block. When the latch is mounted in a second position on the first clamp member, the latch is engagable with a second latch block. When the first latch block wears out, the latch may be moved from the first position to the second position to engage the second latch block. Therefore, the entire gripper assembly does not have to be disassembled to replace a worn out latch block.

When the gripper assembly is attached to a gripper conveyor for transporting articles, the latch may be mounted in its first position on a first clamp member. By having the latch mounted in the first position on some of the gripper assemblies and mounted in the second position on the other gripper assemblies articles can be released in two different locations along the gripper conveyor. Two cam means can be located at the two different locations along the gripper conveyor. One cam means engages the latches mounted in the first position and the other cam means engages the latches mounted in the second position. In this way the articles are released in two different locations.

Another advantage to having the latches mounted in different positions is that it enables the gripper conveyor to travel at high speeds and not limited by the speed of operation of the latch release mechanism. The means for releasing the latches, for example, may be reciprocal members. Both members may release the articles at the same location along the gripper conveyor. One member reciprocates into engagement with the latches mounted in the first position and the other reciprocates into engagement with the latches in the second position. The gripper conveyor can travel at a high speed because while one member moves into engagement with a latch the other member is moving away from the engaging position. If only one member engaged all the latches the gripper conveyor would have to travel at a speed that allowed the member to travel through its full motion between each gripper.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF THE PREFERRED EMBODIMENT OF THIS PRESENT INVENTION

Figure 1:
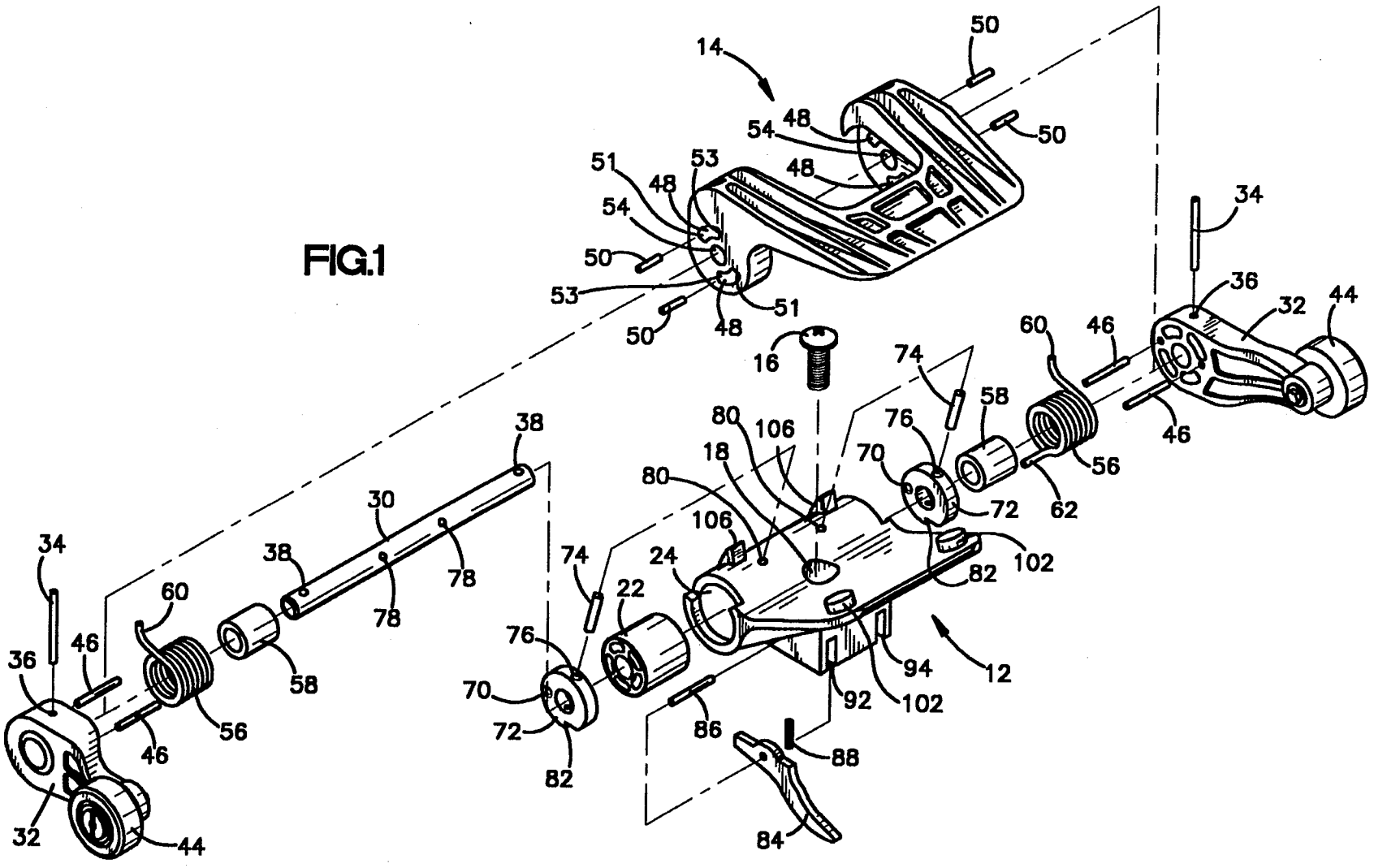
FIG. 1 is an exploded view of a gripper assembly; embodying the present invention.
Figure 2:
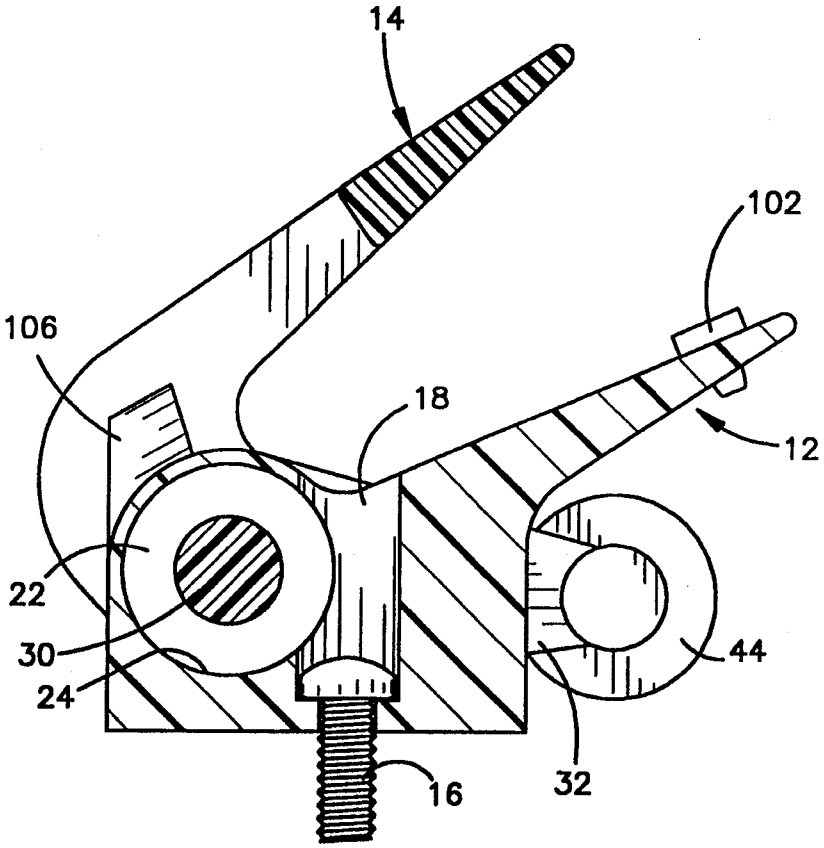
FIG. 2 is a sectional view of the gripper assembly of FIG. 1.

A gripper assembly (FIG. 1) has a first clamp member 12 and a second clamp member 14 which is pivotal relative to the first clamp member from an open position to a closed position in which the gripper assembly clamps an article to transport the article. The first clamp member 12 may be fixedly attached to a gripper conveyor by a screw 16 that extends through an opening 18 (FIG. 2) in the first clamp member. The screw 16 is blocked from removal from the first clamp member 12 by a bearing 22. The bearing 22 is fixed in an opening 24 in the first clamp member 12. The openings 24 and 18 intersect so that the bearing 22 extends into the opening 18. The screw 16 is placed in the opening 18 before the bearing 22 is placed in the opening 24. The bearing 22 blocks part of the opening 18 thus preventing the screw 16 from falling out of the opening 18.

The bearing 22 supports a shaft 30 (FIG. 1) for rotation relative to the first clamp member 12. The shaft 30 extends through the opening 24 in the first clamp member 12. Two arms 32 are connected to the opposite axial ends of the shaft 30. The first clamp member 12 is located between the arms 32. The arms 32 are fixedly connected to the shaft 30 by pins 34. The pins 34 extend through openings 36 in the arms 32 and into openings 38 in the shaft 30. Connected to the arms 32 are rollers 44. The rollers 44 engage cam means along the gripper conveyor to pivot the arms 32 relative to the first clamp member 12. By pivoting the arms 32, the second clamp member 14 is also pivoted relative to the first clamp member 12.

Attached to the arms 32 are pins 46 that extend into slots 48 in the second clamp member 14. When the second clamp member 14 is in the open position, the pins 46 engage bumpers 50 located in first end portions 51 of the slots 48. When the second clamp member 14 is in the closed position the pins 46 are located between the bumpers 50 and second end portions 53 of the slots 48.

The second clamp member 14 has openings 54 through which the shaft 30 extends. The second clamp member 14 is rotatably supported on the shaft 30. Therefore, the arms 32 can pivot relative to the second clamp member 14 to move the pins 46 away from the bumpers 50 when the second clamp member engages an article.

Coil springs 56 are mounted on spacers 58. The spacers 58 are rotatably supported on the shaft 30. Axial outer end portions 60 of the coil springs 56 fixedly engage in slots (not shown) in the second clamp member 14. Axial inner end portions 62 of the coil springs 56 fixedly engage in openings 70 in latch blocks 72.

The latch blocks 72 are fixedly connected to the shaft 30. Pins 74 extend through openings 76 in the latch blocks 72 and into openings 78 in the shaft 30. The first clamp member 12 has openings 80 through which the pins 74 are inserted to connect the latch blocks 72 to the shaft 30. Therefore, the shaft 30, the arms 32, the latch blocks 72 and the axial inner end portions 62 of the springs 56 are fixedly connected together.

The springs 56 are preloaded. When the second clamp member 14 is in the open position the springs 56 force the pins 46 against the bumpers 50 in the slots 48. Therefore, the springs 56 apply no net force on the second clamp member 14. The axial outer end portions 60 of the springs 56 act on the second clamp member 14 at the slots in which the springs engage the second clamp member. The axial inner end portions 62 of the springs 56 act on the second clamp member 14 through the latch blocks 72, the shaft 30, the arms 32 and the pins 46. Therefore, the second clamp member 14, the arms 32, the shaft 30, the latch blocks 72 and the springs 56 pivot together relative to the first clamp member 12 until the second clamp member engages an article.

The arms 32 pivot relative to the first clamp member 12 causing the second clamp member 14 to engage an article. The arms 32 continue to pivot relative to the first clamp member 12 and also relative to the second clamp member 14. When the arms 32 pivot relative to the second clamp member 14, the pins 46 are moved out of engagement with the bumpers 50. The springs 56 act on the second clamp member 14 only at the slots in which the axial outer end portions 60 engage the second clamp member to cause the second clamp member to grip an article. Since the springs 56 are preloaded, a slight movement of the pins 46 away from the bumpers 50, as when gripping a thin article, causes the springs to apply a relatively large force on the second clamp member 14.

The latch blocks 72 have a gap 82 (FIG. 3) into which a latch 84 can engage. The latch 84 is pivotally mounted on the first clamp member 12 by a pin 86. A spring 88 located in an opening in the first clamp member 12 biases the latch 84 into engagement with one of the latch block 72. The latch 84 engages in the gap 82 in one of the latch blocks 72 to hold the second clamp member 14 in the closed position.

Figure 3:
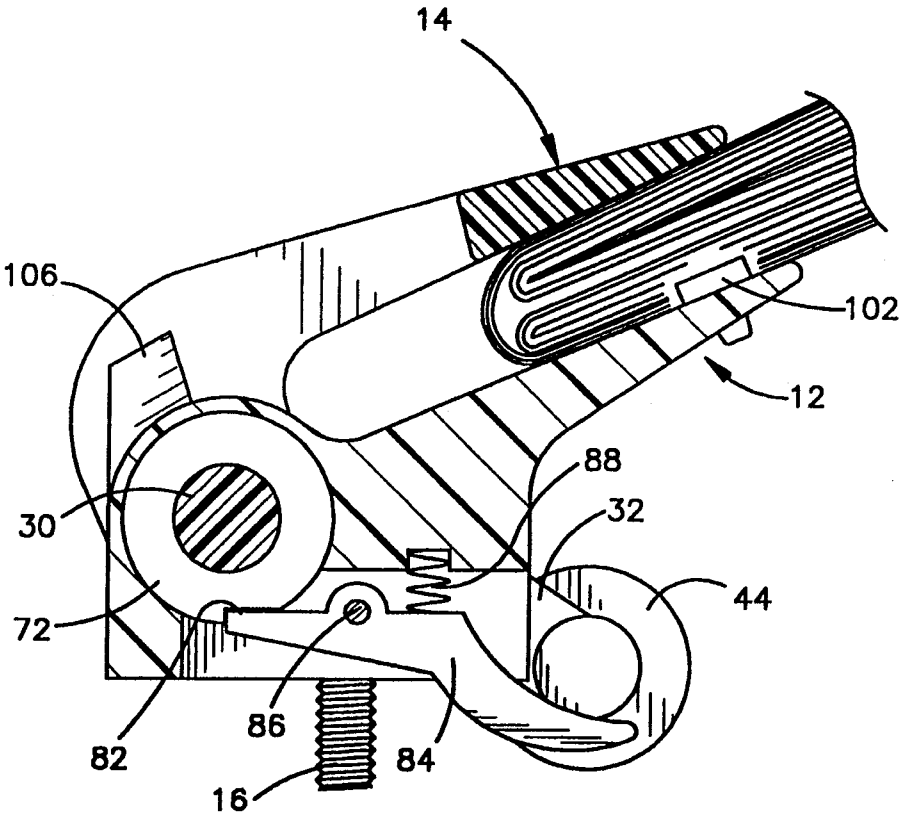
FIG. 3 is a sectional view of the gripper assembly of FIG. 1 clamping an article.

The latch 84 (FIG. 1) can be mounted in a first position, slot 92, on the first clamp member 12 to engage one of the latch blocks 72. The latch 84 can be mounted in a second position, slot 94, to engage the other latch block 72. Thus, if one of the latch blocks 72 is worn out, the latch 84 can be mounted on the first clamp member 12 in the position to engage the other latch block 72. When the latch 84 engages the gap 82 of either one of latch blocks 72, the second clamp member 14 is held in a position in which an article is gripped between the second clamp member and the first clamp member 12 (FIG. 3).

The first clamp member 12 (FIG. 1) includes gripper pads 102 that increase the coefficient of friction between the gripped article and the gripper assembly. The first clamp member 12 also includes stops 106 which prevent the second clamp member 14 from pivoting too far relative to the first clamp member 12 when in the open position.

When the gripper assembly is to grip an article, the conveyor moves the gripper assembly to a pick-up station with the gripper assembly in a fully open position. As the gripper assembly 10 approaches the position in which it is to grip an article, the roller 44 on the arm 32 moves into engagement with a cam. Continued movement of the gripper assembly 10 causes the cam to pivot the arms 32 and the second clamp member 14 from a fully open position to a closed position.

As the second clamp member 14 moves toward the closed position, the second clamp member engages an article and clamps it to the first clamp member 12 which prevents further closing of the second clamp member 14. The arm 32 continue to pivot relative to the first clamp member 12 and also relative to the second clamp member 14. As the arms 32 continues pivoting, it also rotates the shaft 30 and therefore the latch blocks 72. Since the axial inner end portions 62 of the coil springs 56 are attached to the latch blocks 72, the coil springs are compressed further to increase the clamping force between the second clamp member 14 and the first clamp member 12. Therefore, the thicker the article that is gripped, the larger the force applied by the springs 56.

The arm 32 continues pivoting the latch block 72 until the latch 84 engages in the gap 82 in the latch block. The latch 84 locks the gripper assembly in the closed position. The springs 56 are in a compressed state applying a gripping force to the second clamp member 14.

At a receiving station where the article is released, the latch 84 engages a cam means pivoting the latch 84 relative to the first clamp member 12 to release the latch block 72. Upon release of the latch block 72, the springs 56 cause the latch blocks 72, the shaft 30, and the arms 32 to pivot releasing some of the tension in the springs 56. The arms 32 pivot to a point where the pins 46 engage the bumpers 50 in the slots 48 of the second clamp member 14. The second clamp member 14 and the arms 32 are pivotal together relative to the first clamp member 12. The rollers 44 engage a cam to pivot the arms 32 and the second clamp member 14 to an open position in which the article is released.

From the above description of the invention, those skilled in the art will perceive improvements, changes and modifications. Such improvements, changes and modifications within the skill of the art are intended to be covered by the appended claims.

Having described the invention, the following is claimed:

1. A gripper assembly for clamping an article, said gripper assembly comprising a first clamp member, a second clamp member, actuation means for pivoting said second clamp member relative to said first clamp member from an open position to a closed position in which said gripper assembly clamps an article, a releasable locking device for retaining said second clamp member in the closed position, a coil spring connected between said actuation means and said second clamp member, said coil spring being loaded while said second clamp member is in the open position, said coil spring being compressed further when said second clamp member engages an article and said actuation means pivots relative to said second clamp member to close said second clamp member, and means for maintaining the compressed condition of said coil spring when said second clamp member is in the open position, said maintaining means comprising a pin engaging in a slot.

2. A gripper assembly as set forth in claim 1 wherein said pin is connected with said actuation means and the slot is in said second clamp member.

3. A gripper assembly as set forth in claim 1 wherein said pin engages a bumper located in a first end portion of the slot when said second clamp member is in the open position, and said pin is located between said bumper and a second end portion of the slot when said second clamp member is in the closed position.

4. A gripper assembly for clamping an article, said gripper assembly comprising a first clamp member, a second clamp member, actuation means for pivoting said second clamp member relative to said first clamp member from an open position to a closed position in which said gripper assembly clamps an article, a releasable locking device for retaining said second clamp member in the closed position, and a coil spring for applying a clamping force on said second clamp member to clamp the article between the first and second clamp members, said coil spring comprising a series of adjacent coils of substantially equal diameter, one of said coils being connected to said actuation means and another of said coils being connected to said second clamp member, said coil spring being compressed while said second clamp member is in the open position, said coil spring being compressed further when said second clamp member engages an article and said actuation means pivots relative to said second clamp member to close said second clamp member;

said locking device comprising first and second latch blocks, a latch pivotal relative to said first clamp member, said first clamp member having means for mounting said latch in a first position, said latch being biased into engagement with said first latch block to maintain said second clamp member in the closed position, and said first clamp member having means for mounting said latch in a second position for pivotal motion relative to said first clamp member to engage said second latch block to maintain said second clamp member in the closed position.

5. A gripper assembly as set forth in claim 4 wherein said second latch block is coupled to said actuation means.

6. A gripper assembly as set forth in claim 4 further including a second coil spring connected to said second latch block and to said second clamp member.

7. A gripper assembly for clamping an article, said gripper assembly comprising a first clamp member, a second clamp member pivotal relative to said first clamp member, actuation means for pivoting said second clamp member into a closed position in which said gripper assembly clamps an article, and a releasable locking device for maintaining said second clamp member in the closed position, said locking device comprising a latch movable relative to said first clamp member and first and second latch blocks coupled to said actuation means, said first clamp member having means for mounting said latch in first and second positions on said first clamp member, said latch when mounted in the first position on said first clamp member being engagable with said first latch block to maintain said second clamp member in the closed position, said latch when mounted in the second position on said first clamp member being engagable with said second latch block to maintain said second clamp member in the closed position.

8. A gripper assembly as set forth in claim 7 further including spring means applying a clamping force to clamp the article between said first and second clamp members, said spring means comprising a first spring connected between said first latch block and said second clamp member and a second spring connected between said second latch block and said second clamp member.

9. A gripper assembly as set forth in claim 7, further including bearing means supporting said actuation means for rotation relative to said first clamp member, said bearing means retaining means for attaching said gripper assembly to a gripper conveyor in said first clamp member.

10. A gripper assembly as set forth in claim 7, wherein said actuation means engages said second clamp member upon release of said latch from one of said first and second latch blocks.

11. A gripper assembly as set forth in claim 7, wherein said actuation means includes first and second actuation arms connected to first and second rollers, respectively, which are engagable with cam means to pivot said second clamp member relative to said first clamp member, said first and second actuation arms being located on opposite sides of said gripper assembly.

12. A gripper assembly for clamping an article, said gripper assembly comprising a first clamp member, a second clamp member, actuation means for pivoting said second clamp member relative to said first clamp member from an open position to a closed position in which said gripper assembly clamps an article, a releasable locking device for retaining said second clamp member in the closed position, and a coil spring for applying a clamping force on said second clamp member to clamp the article between the first and second clamp members, said coil spring comprising a series of adjacent coils of substantially equal diameter, one of said coils being connected to said actuation means and another of said coils being connected to said second clamp member, said coil spring being compressed while said second clamp member is in the open position, said coil spring being compressed further when said second clamp member engages an article and said actuation means pivots relative to said second clamp member to close said second clamp member;

said locking device comprising a first latch block coupled to said actuation means and a latch pivotal relative to said first clamp member, said first clamp member having means for mounting said latch in a first position, said latch being biased into engagement with said first latch block to maintain said second clamp member in the closed position.

13. A gripper assembly for clamping an article, said gripper assembly comprising a first clamp member, a second clamp member, actuation means for pivoting said second clamp member relative to said first clamp member from an open position to a closed position in which said gripper assembly clamps an article, a releasable locking device for retaining said second clamp member in the closed position, and a coil spring for applying a clamping force on said second clamp member to clamp the article between the first and second clamp members, said coil spring comprising a series of adjacent coils of substantially equal diameter, one of said coils being connected to said actuation means and another of said coils being connected to said second clamp member, said coil spring being compressed while said second clamp member is in the open position, said coil spring being compressed further when said second clamp member engages an article and said actuation means pivots relative to said second clamp member to close said second clamp member;

said locking device comprising a first latch block and a latch pivotal relative to said first clamp member, said first clamp member having means for mounting said latch in a first position, said latch being biased into engagement with said first latch block to maintain said second clamp member in the closed position, said coil spring being connected to said first latch block and to said second clamp member.

14. A gripper assembly for clamping an article, said gripper assembly comprising a first clamp member, a second clamp member, actuation means for pivoting said second clamp member relative to said first clamp member from an open position to a closed position in which said gripper assembly clamps an article, a releasable locking device for retaining said second clamp member in the closed position, and a coil spring for applying a clamping force on said second clamp member to clamp the article between the first and second clamp members, said coil spring comprising a series of adjacent coils of substantially equal diameter, one of said coils being connected to said actuation means and another of said coils being connected to said second clamp member, said coil spring being compressed while said second clamp member is in the open position, said coil spring being compressed further when said second clamp member engages an article and said actuation means pivots relative to said second clamp member to close said second clamp member;

said actuation means including first and second actuation arms connected to first and second rollers, respectively, which are engageable with a cam means to pivot said second clamp member relative to said first clamp member, said first and second arms being located on opposite sides of said gripper assembly.

* * * * *